United States Patent [19]

Cancelosa et al.

[11] Patent Number: 4,998,838

[45] Date of Patent: Mar. 12, 1991

[54] COVER MAKE-UP DISPENSER

[76] Inventors: Tammy J. Cancelosa, 17613 Kingsbrook Cir., Mt. Clemens, Mich. 48044; Tammy J. Matthews, 62 B Clubhouse La., Fairfield, Ohio 45014

[21] Appl. No.: 571,789

[22] Filed: Aug. 24, 1990

[51] Int. Cl.[5] ..... A45D 34/00

[52] U.S. Cl. ..... 401/202; 401/38; 401/207

[58] Field of Search ..... 401/198, 202, 37, 38, 401/23, 123, 124, 126, 9, 130, 207; 132/320

[56] References Cited

U.S. PATENT DOCUMENTS

| | | | |
|---|---|---|---|
| 4,002,182 | 1/1977 | Michel | 401/202 |
| 4,089,609 | 5/1978 | Gring et al. | 401/130 |
| 4,368,746 | 1/1983 | Spatz | 401/202 |
| 4,480,940 | 11/1984 | Woodruff | 401/206 |
| 4,652,163 | 3/1987 | Karliner | 401/195 |
| 4,674,903 | 6/1987 | Chen | 401/266 |
| 4,747,720 | 5/1988 | Bellehumeur | 401/205 |
| 4,889,441 | 12/1989 | Tice | 401/131 |

FOREIGN PATENT DOCUMENTS

| | | | |
|---|---|---|---|
| 1087817 | 9/1954 | France | 401/37 |

*Primary Examiner*—Richard J. Johnson
*Attorney, Agent, or Firm*—Charles R. Wilson

[57] ABSTRACT

A dispenser for the convenient application of a liquid facial cover make-up has means for the daubing and blending of the make-up without the user's fingers having to touch the make-up. The dispenser comprises a container for holding the liquid cover make-up, a reservoir base positioned on the container and having an opening therethrough so as to be in communication with the container's contents, an applicator sponge positioned in the reservoir base with a retainer sleeve to hold it permanently in place, a blender pad base and blender pad removably positioned over the applicator sponge and a cover cap removably positioned over the blender pad base.

10 Claims, 3 Drawing Sheets

COVER MAKE-UP DISPENSER

This invention relates to a cosmetic dispenser. More particularly, the invention relates to a dispenser capable of dispensing a liquid make-up directly onto facial area and blending it evenly thereon.

A relatively popular cosmetic used by a significant segment of the public is a cover make-up. The cover make-up is applied to a facial area and blended thereon. It has an approximate skin color or is slightly darker and can serve as a base for a subsequently applied high-light make-up. The cover make-up's prime purpose is to cover over any skin blemishes, freckles, etc. to give the face a clear clean appearance.

Known cover make-ups come in a liquid form. They are typically poured or squeezed from a container onto an applicator sponge or onto the user's finger tips and then applied to the facial area. The same applicator sponge, a clean sponge, or possibly still the finger tips is then used to blend the cover make-up evenly over the facial are until the desired appearance is achieved. Even with the aid of an applicator sponge, the user's fingers will make direct contact with the make-up. This requires the user to exercise a high degree of care to ensure that clothing or another part of the body is not touched prior to a through hand washing.

Various skin lotion and cosmetic dispensers have been developed. Any successful dispenser must be able to securely retain its contents during shipping and be able to withstand accidental bumpings and droppings. It must also be capable of readily dispensing its contents. Several dispensers are presently on the market which meet the aforementioned criteria. These include dispensers which contain liquid cover made-up.

Certain of the known cosmetic dispensers also have features which allow the direct dispensing of their contents into an applicator member for the sake of convenience. For example, U.S. Pat. Nos. 4,089,609, 4,480,940, 4,674,903, 4,747,720 and 4,889,441 all contain disclosures of hand held articles which have a container portion, a dispensing opening, and an applicator member mounted in direct association with the dispensing opening. The user inverts or squeezes the container to force its contents through the dispenser opening and directly onto a porous absorbent material which serves as the applicator member. The loaded applicator member is then wiped or rubbed across the facial area or other body area so as to transfer the cosmetic. Such articles do allow the dispensing and application of a cosmetic directly onto the body without the need to use separate sponges or cotton swatches. However, the application is rather crude in that the amount and percise blending of the cosmetic is not easily controlled. The result is that the user may still have to use her fingers for a final blending step.

It should be noted that present dispensers are designed based on the physical characteristics of its contents, e.g. viscosity, pourability, etc. An article which may be very suitable for the dispensing and applying of one cosmetic may be inadequate for another cosmetic formulated for a different purpose with different physical characteristics. In particular, there is no dispenser known which is capable of holding, dispensing, and applying a cover make-up in manner which is needed and desired. In accord with this need, there has been developed a dispenser especially designed for use with a liquid cover make-up. The dispenser satisfies a need for the convenient, mess-free application of the cover make-up to a facial area without a need for the fingers to come in direct contact with the make-up.

SUMMARY OF THE INVENTION

A dispenser for the convenient application of a facial liquid cover make-up directly to the facial area of the user without contact by the user's hands or fingers comprises a container, a reservoir base mounted on the container, an applicator sponge securely positioned in the reservoir base, a blender pad base with blender pad positioned over the applicator sponge and further adapted to be manually separated therefrom during use, and a cover cap designed to fit over the blender pad base and applicator sponge to keep them moist and protected during periods of non-use. The container portion of the dispenser has pliable side walls which allow its contents to be forced through an opening and directly into the applicator sponge. The dispenser is designed to be used for the initial application of the liquid cover make-up onto the facial area by use of the applicator sponge and the convenient blending of the applied make-up by use of the blender pad.

DETAILED DESCRIPTION OF THE INVENTION

The despenser of the invention is described with particular reference to the drawings. The dispenser is designed to hold, dispense and apply a conventional commercially available cover make-up. It should be understood the dispenser is uniquely suited for this product and the description which follows is with this end use in mind. The dispenser, however, could be used for other cosmetic products which have similar physical characteristics and similar modes of use.

Figure 1:
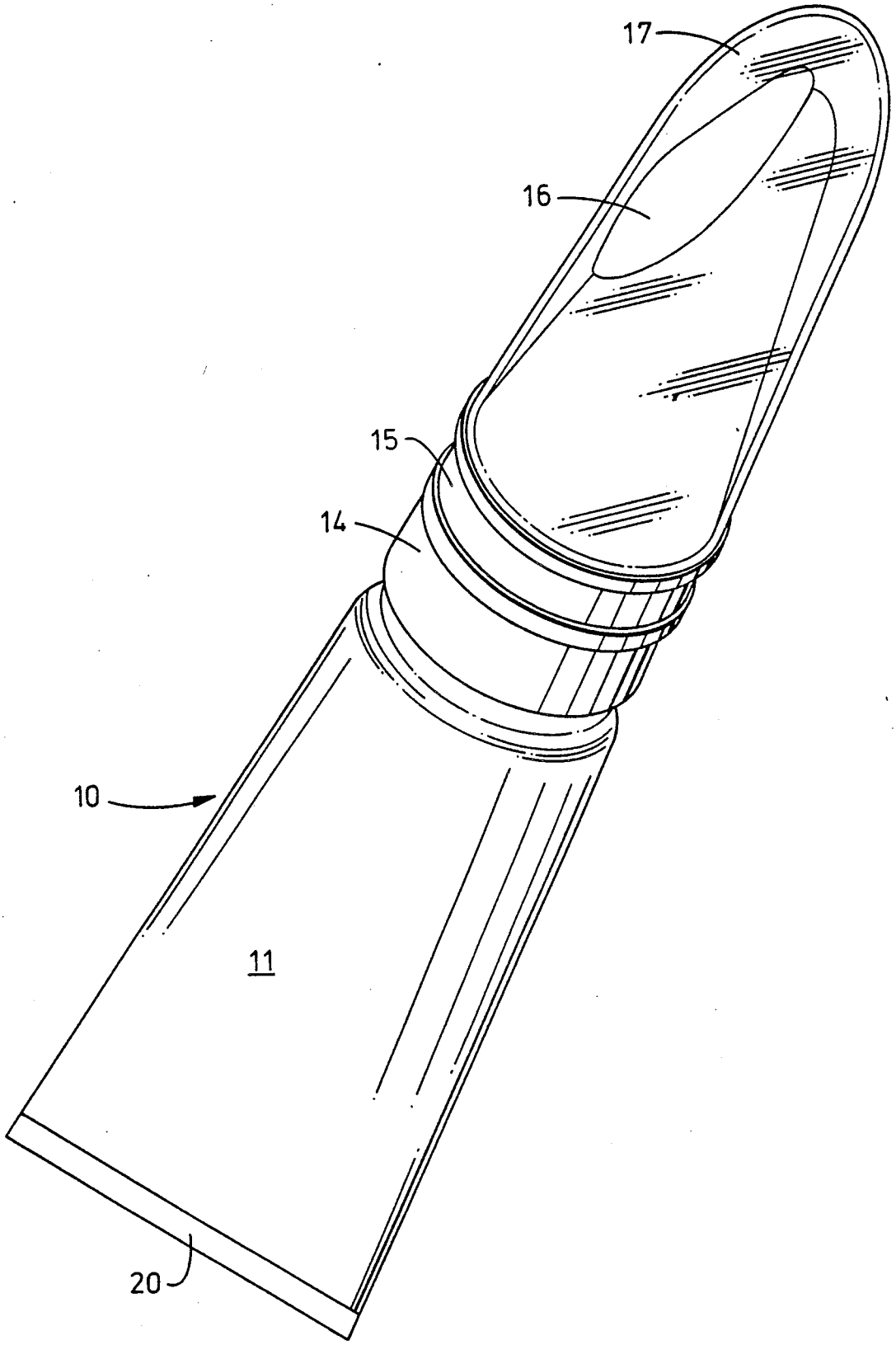
FIG. 1 is a view in perspective of the dispenser of this invention.
Figure 2:
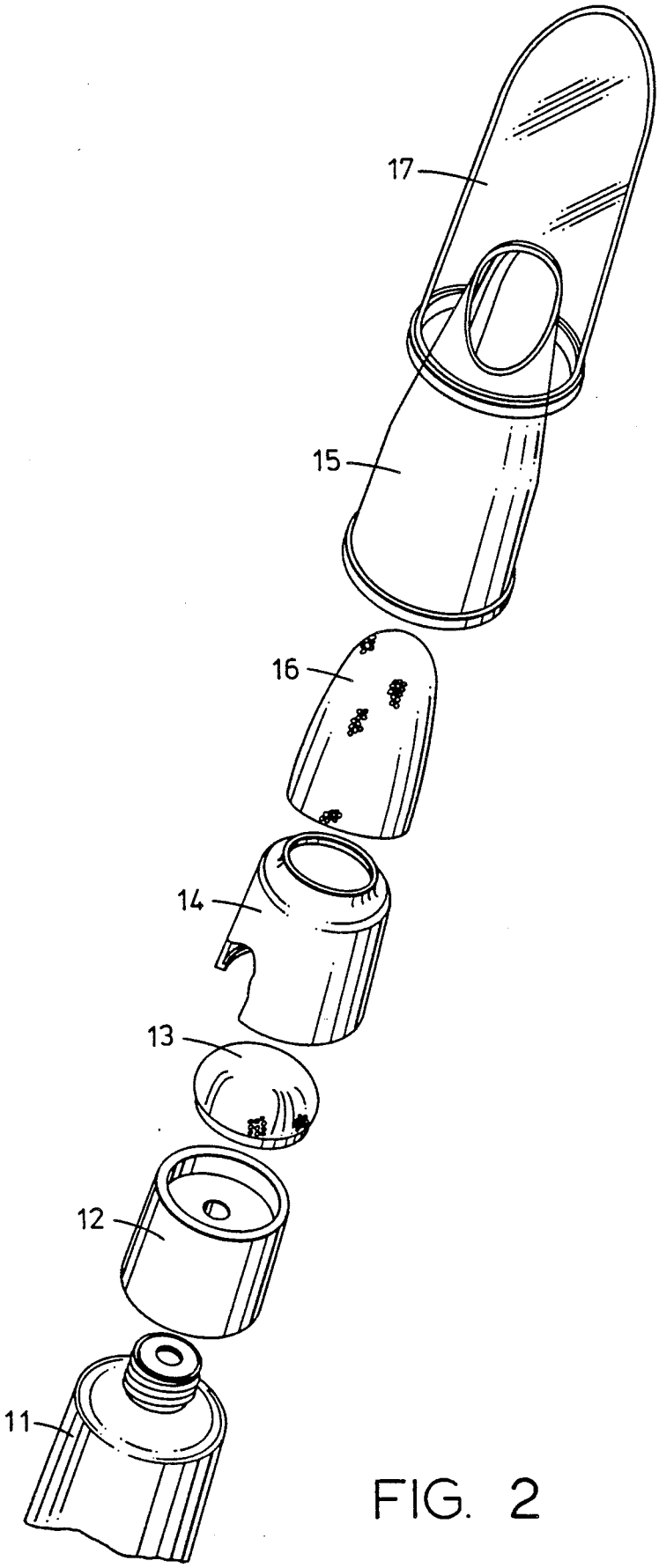
FIG. 2 is an exploded view of the dispenser of FIG. 1 showing the individual components of the dispenser.

With reference to FIGS. 1 and 2, there is shown a dispenser 10. The essential components of the dispenser are a container 11, a reservoir base 12, an applicator sponge 13, a retainer means 14 positioned on the reservoir base to securely hold the applicator sponge in position, a removable blender pad base 15 with blender pad 16, and a cover cap 17. The components are dimensioned to fit together to form a dispenser which is manufactured and sold as a complete unit. The individual dispenser components and their interaction with one another are described in detail in the following paragraphs.

Figure 3:
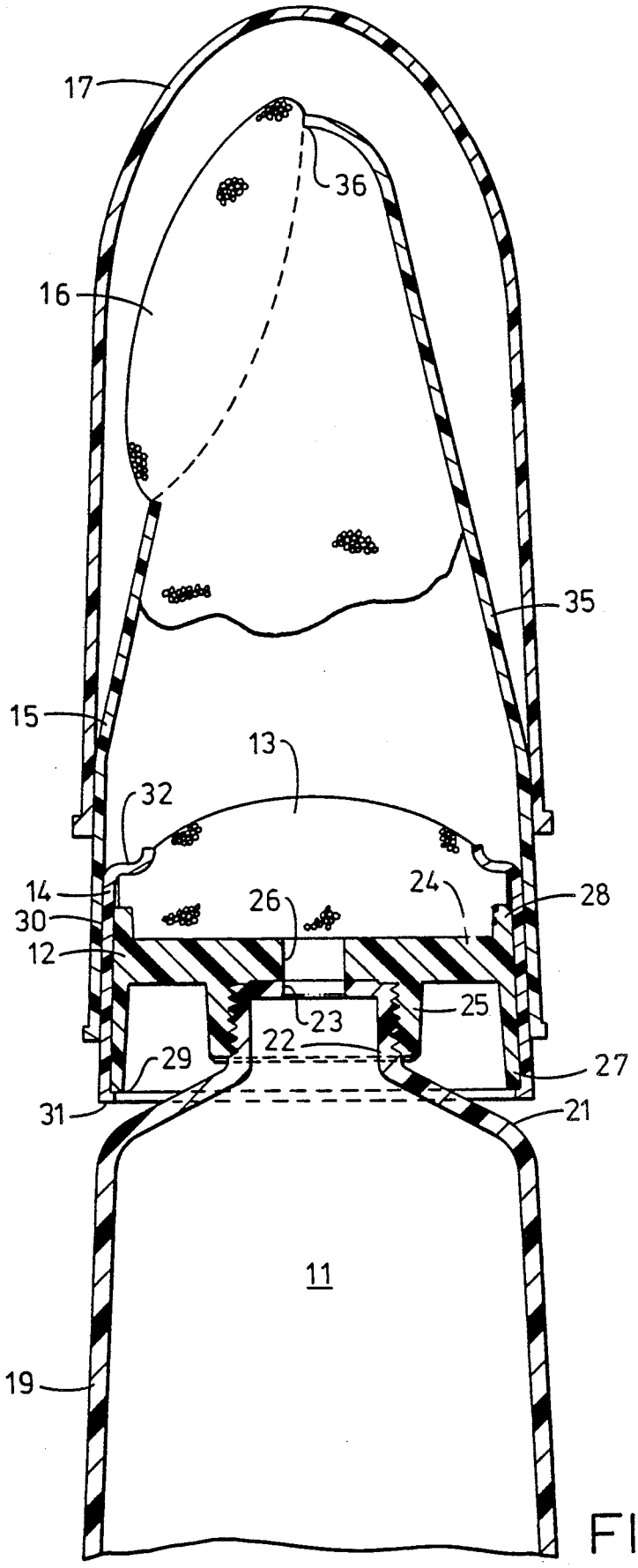
FIG. 3 is a sectional view of the dispenser of FIG. 1.

The container 11 is dimensioned to hold up to about 20 oz. of liquid cover make-up. It can be virtually any shape depending on the user's perceived desires. For manufacturing reasons the container preferably has an elongated cylindrical configuration. With reference to FIGS. 1 and 3, the lower portion of the side walls 19 are tapered to culminate in a narrow creased bottom seam 20. A shoulder 21 extends from the top portion of the side walls. The shoulder along with a neck 22 extending therefrom close off the upper portion of the container. A centrally disposed opening 23 in the neck is provided through which the container's contents are dispensed. The container is thin walled and pliable. It is typically molded from a plastic resin to the desired shape. Preferably, the container has threads molded into the neck to provide a means by which to secure the reservoir base 12 to the container 11.

The reservoir base 12 is dimensioned to be positioned on the container 11 and be firmly attached thereto. The base is preferably detachable from the container to allow filling of the container body with the cover make-up. The reservoir base comprises a main body 24 with a lower internally threaded hub 25 to fit the neck threads of the container. A passageway 26 extends through the hub and is in alignment with the opening 23 of the container. A lower annular flange 27 extends vertically downwardly from the base and an upper annular flange 28 extends vertically upwardly from the base. The terminus of the lower flange provides a lip 29 for receiving the retainer means 14. The upper annular flange 28 forms an open top reservoir. As described in more detail below, the open top reservoir base provides a means by which the liquid cover make-up in the container can be received and evenly dispersed into an application sponge.

The application sponge 13 sits in the open top reservoir. The sponge is dimensioned to fit within the confines formed by the upper annular flange 28 of the base, though it does extend vertically therefrom for ease of use. The applicator sponge is made of a soft elastic porous material through which the cover make-up is able to migrate to the sponge's outer surface. Bore holes in the sponge can futher be provided to aid in passage of the cover make-up. Suitable sponge materials are the synthetic open-cell foams commercially available. As most evident in FIG. 3 the applicator sponge has a concaved top surface to aid in its use. This shape is preferred, though not necessary.

The retainer means 14 is a tube-shaped sleeve 30 dimensioned to snap-fit over the reservoir base and applicator sponge to hole them permanently together. The sleeve 30 encircles the reservoir base. It has a lower inward annular flange 31 which extends from the sleeve's lowermost edge to fit over the lip of the reservoir base's lower flange 27; it also has an upper inward annular flange 32 which extends from the sleeve to fit over a portion of the applicator sponge. The flange 32 extends inwardly a sufficient distance to physically hold the applicator sponge in place, yet allows sufficient sponge surface area for proper use. This means of mounting avoids a need for adhesives or separate attachment means.

Fitting over the applicator sponge is a removable blender pad base 15. The blender pad base 15 has a generally elongated frustoconical-shaped housing 35. The lower portion of the housing is hollow and has an open bottom diameter which allows the housing to fit snugly over the reservoir base's side walls and retainer means. The diameter of the open bottom permits the blender pad base 15 to readily slip over the reservoir base to hold it in place during shipping and storage, yet is readily removed during the dispenser's use as described below. The blender pad base has an upper opening 36 near the housing's top sufficiently large to expose the blender pad 16. The opeing is preferably located in a side wall of the housing near its top and is about 0.5 inches to about 1.5 inches in its cross dimensions. The resultant disposition of the blender pad allows a convenient and natural hand-held use of the blender pad. For manufacturing purposes, the housing 35 is shaped to accommodate the blender pad 16 in its top. In effect, the pad can be forced into the housing sufficiently to extend slightly through the opening 36 and be permanently mounted in the housing by a suitable adhesive.

Several different materials can be used to form the blender pad. These include synthetic materials such as open-cell and close-cell synthetic foams and natural materials. A highly preferred blender pad is made from chamois. Chamois is widely available. It is made from sheepskin and is used for various purposes. It has been found the chamois is especially useful for the blending of the cover make-up due to its porosity and ability to remain moist. For best results the chamois is a covering adhered to a foam substrate and positioned in the blender pad base.

A cover cap 17 is also provided. It is generally cylindrical-shaped with an open bottom dimensioned to fit over the blender pad and snugly fit onto the side walls of the blender pad base. It is preferably made of a clear plastic for aesthetic reasons, though can as well be molded from opaque plastic. It is rigid or semi-rigid and provides a means to protect the blender pad during shipping and storage.

In use, the dispenser's cover cap and blender pad base are separately removed from the container and set aside. A slight squeezing of the container will force the liquid cover make-up through its neck opening and into the applicator sponge. Routine experimentation will tell the user the proper amount of squeezing which is needed to effectively saturate the applicator sponge without an excess of the cover make-up remaining. The container with its loaded applicator sponge is lifted to the face and the make-up daubed onto the face in selected areas. The user next picks up the blender pad base and wipes the blender pad over the face to evenly blend the make-up to the desired areas and degree. Alternatively, the blender pad base can be placed back onto the container and then used for blending purposes if the user feels this is more convenient. Finally, the cover cap and, if not previously done, the blender pad base are replaced onto the container and the dispenser stored for future use. As should be readily apparent, the user's finger-tips never directly contact the cover make-up.

While the invention has been described with reference to the drawings it should be understood various changes of an obvious nature are considered to be a part of the invention and come within the scope of the appended claims.

What is claimed is:

1. A dispenser for the convenient application of a facial cover make-up without contact of the cover make-up on the hands or fingers of the user, said dispenser comprising:

(a) a container for holding liquid cover make-up, said container having an opening for dispensing purposes and further having pliable side walls such that the container's contents can be readily forced from the container through the opening;

(b) a reservoir base positioned on the container and in communication with the container's opening, said base having a main body with an upper annular flange extending therefrom to create an open top reservoir and further having a passageway through the base which is aligned with the opening in the container so as to receive the liquid cover make-up when forced from the container;

(c) an applicator sponge positioned in the open to reservoir of the reservoir base, said sponge capable of becoming substantially evenly saturated with the liquid cover make-up;

(d) a retainer means positioned on the reservoir base to hold the applicator sponge such that a substantial portion of the applicator sponge remains exposed yet is retained in place during use;

(e) a removable blender pad base comprised of a hollow housing dimensioned to sit over the applicator sponge and onto the reservoir base to effectively cover the applicator sponge during non-use and a blender pad permanently mounted in the housing, said blender pad base dimensioned to be held in the hand and capable of blending the cover make-up into the facial area in an efficient manner; and (f) a removable cover cap dimensioned to fit over the removable blender pad base to cover the blender pad during non-use and retain said pad in a moist state.

2. The dispenser of claim 1 wherein the container has an elongated cylindrical-shape with tapered side walls culminating in a sealed bottom seam and a shoulder and neck extending from an upper portion of the side walls.

3. The dispenser of claim 2 further wherein the neck of the dispenser has threads and the reservoir base is threadably engaged thereto.

4. The despenser of claim 3 wherein the reservoir base further has a hub with internal threads to threadably engage the threads on the neck.

5. The dispenser of claim 4 wherein the reservoir base further has a lower annular flange extending from the main body.

6. The despenser of claim 5 wherein the retainer means is a sleeve which encases the reservoir base, said sleeve having a lower annular flange to engage a lip of the reservoir base's lower annular flange and an upper annular flange to engage the applicator sponge.

7. The dispenser of claim 6 wherein the blender pad base has a generally frustoconical-shaped housing with an opening near its top sufficiently large to expose the blender pad.

8. The dispenser of claim 7 wherein the opening in the frustoconical-shaped housing of the blender pad base is about 0.5 inches to about 1.5 inches in its cross dimensions and is located in a side wall of the housing near its top for the convenient use of the blender pad mounted therein.

9. The dispenser of claim 8 wherein the blender pad is made of chamois.

10. The dispenser of claim 9 wherein the chamois is a covering adhered to a foam substrate and positioned in the blender pad base to expose the chamois covering.

* * * * *